US005113775A

United States Patent [19]

Imhoff

[11] Patent Number: 5,113,775

[45] Date of Patent: May 19, 1992

[54] AERO HYDROFOIL SAIL BOAT

[76] Inventor: Robert W. Imhoff, 2062 Hanscom Dr., South Pasadena, Calif. 91030

[21] Appl. No.: 575,227

[22] Filed: Aug. 30, 1990

Related U.S. Application Data

[63] Continuation-in-part of Ser. No. 345,842, May 1, 1989, abandoned.

[51] Int. Cl.[5] ..... B63H 9/04

[52] U.S. Cl. ..... 114/39.1; 114/162; 114/274

[58] Field of Search ..... 114/39.1, 61, 102, 103, 114/140, 162, 274, 280

[56] References Cited

U.S. PATENT DOCUMENTS 3,295,487 1/1967 Smith ..... 114/39.1
3,646,902 3/1972 Smith ..... 114/39.1
4,228,750 10/1980 Smith et al. ..... 14/39.1
4,273,060 6/1981 Pavincic ..... 114/39.1
4,671,198 6/1987 Snead ..... 114/39.1

*Primary Examiner*—Sherman Basinger
*Attorney, Agent, or Firm*—Fulwider, Patton, Lee & Utecht

[57] ABSTRACT

A high-speed, ultrastable, wind propelled watercraft employs an airfoil for propulsion and buoyant hydrofoils for support. A buoyant keel/rudder is rotatably mounted to a boom which horizontally projects from near the base of the airfoil. Both the airfoil and the keel/rudder steering axis are inclined from the vertical substantially in parallel. The particular orientation, freedom of movement, and shapes of the various foil, support and control surfaces enhances the maneuverability of the craft and allows the craft to be sailed at most pointing angles.

14 Claims, 6 Drawing Sheets

AERO HYDROFOIL SAIL BOAT

This application is a continuation-in-part of application Ser. No. 07/345,842 filed May 1, 1989, and now abandoned.

BACKGROUND OF THE INVENTION

The present invention relates generally to sail boat design, and more particularly, pertains to watercraft that employ hydrofoils for support and an airfoil for wind powered propulsion.

Hydrodynamic drag comprises by far and away the greatest component of resistance to a boat's forward progress. It has long been recognized that such drag forces can be reduced by optimizing a hull's shape to reduce frontal or wetted area or by modifying a hull's shape to induce a planing attitude at speed which further reduces both frontal and wetted area. A much greater reduction in hydrodynamic drag can be achieved by raising the entire hull clear of the water by force generated by the flow of water across relatively small hydrofoil shaped surfaces. A hydrofoil of sufficient buoyancy can additionally support a boat's weight under static conditions thereby obviating the need for a conventional hull altogether. The concept of a buoyant hydrofoil is disclosed in U.S. Pat. No. 3,094,961 to Bernard Smith.

An additional shortcoming of "conventional" sailboat design is inherent in the behavior of a "conventional" sail. A properly shaped (filled) sail can, in fact, generate more propulsive force by acting as an airfoil with air flowing across its surface to produce "lift" than it can generate by simply catching the wind. The proper "filling" of a sail can, however, only be achieved by presenting the plane of the sail area at a significant angle to the apparent direction of the wind. Higher boat speed, therefore, requires the boat to be sailed further and further off the wind thereby reducing the boat's upwind performance. A solution to this dilemma has been the use of a rigid airfoil. Such a rigid structure will maintain a more optimized airfoil shape regardless of the wind direction and thereby generates higher propulsive forces. An airfoil shape symmetric with respect to the perpendicular bisector of the chord will generate "lift" when air flows in either direction across the foil's surfaces.

While airfoils and hydrofoils have in the past been combined in various high-performance sailing vessel designs, the mere combination of such features does not guarantee an efficient if indeed sailable watercraft. An additional obstacle that has, in fact, always impeded the fitting of large surface area sails to small watercraft, has been the requirement of stability. It is a typical watercraft's inherent instability for which counter measures must be taken to prevent the boat from overturning. In addition to limiting the sail area-to-weight ratio of a particular design, this instability problem has been addressed by the placement of ballast below the waterline, such as by the affixation of a weighted keel, or by shifting ballast from side to side as the boat heels. Another approach involves the use of multiple hulls. This has the effect of spreading out the forces to provide a more stable base. Stability of such structures, is however not unlimited, as sufficient sail area and/or wind velocity will eventually have the effect of overturning the vessel.

In order to construct a more stable craft, all of the force vectors that are involved must be considered, and with the ability to balance all of those force vectors that could result in a turning moment with equal and opposite forces, an "ultrastable" watercraft results that is not prone to turnover regardless of how high a wind velocity it is subjected to. Ultrastable water craft employing airfoils and hydrofoils have in fact been proposed as in the work of Bernard Smith entitled, "The Forty Knot Sailboat". While the various disclosed sailboats do offer high-speed potential and ultrastability, they suffer from shortcomings in regard to their maneuverability. For example, Smith's design requires a reversal in the direction of travel during downwind tacking maneuvers. In addition, the placement, configuration and the restricted freedom of movement of the control surfaces preclude any direct downwind movement (or running) and actually requires downwind tacking at significant angles to the direction of wind. These shortcomings severely limit the maneuverability of such a craft and requires the application of considerably unconventional sailing techniques.

SUMMARY OF THE INVENTION

The boat design of the present invention provides a high performance, ultrastable and highly maneuverable wind-powered watercraft which overcomes many of the disadvantages associated with prior art designs. A substantially rigid airfoil provides the propulsive force and is capable of doing so even at very high pointing angles. Rigidly mounted buoyant hydrofoils support the airfoil both at rest and at speed and are disposed in such a manner so as not to offer any significant leeward resistance. A boom projecting outwardly from the plane of the airfoil along the horizontal is rotatably affixed near the base of the airfoil and rotatably supports, at its distal end, a buoyant keel/rudder with which the direction of progress of the entire craft is controlled. Both the air foil and the keel/rudder's axis of rotation are positioned so as to be inclined from the vertical towards the plane of floatation at all times. As a result, the forces they generate do not produce a net over-turning or capsizing moment. This results in an "ultrastable" craft which is not subject to turnover regardless of wind speed. The symmetry of the keel/rudder and its fully rotatable mounting at the distal end of the boom allows the craft to be sailed at substantially all wind angles including downwind running. In addition, downwind tacks can be performed without the need to stop the vessel nor reverse its direction of movement.

The use of an airfoil increases the craft's aerodynamic efficiency while the use of the hydrofoils reduces its hydrodynamic drag to make high-speed progress possible. The relative placement and angling of the airfoil, lack of leeward resistance by the hydrofoils, and extended and angled position of the keel/rudder imparts the ultrastability to the craft that enables it to be sailed in high winds such that full advantage can be taken of its aerodynamic and hydrodynamic efficiencies. Most importantly, the location of the keel/rudder its fully symmetric shape along with its substantially unrestricted freedom of rotation enables the craft to be sailed in a reasonably conventional manner to take advantage of most wind situations.

DETAILED DESCRIPTION OF THE INVENTION

Figure 1:
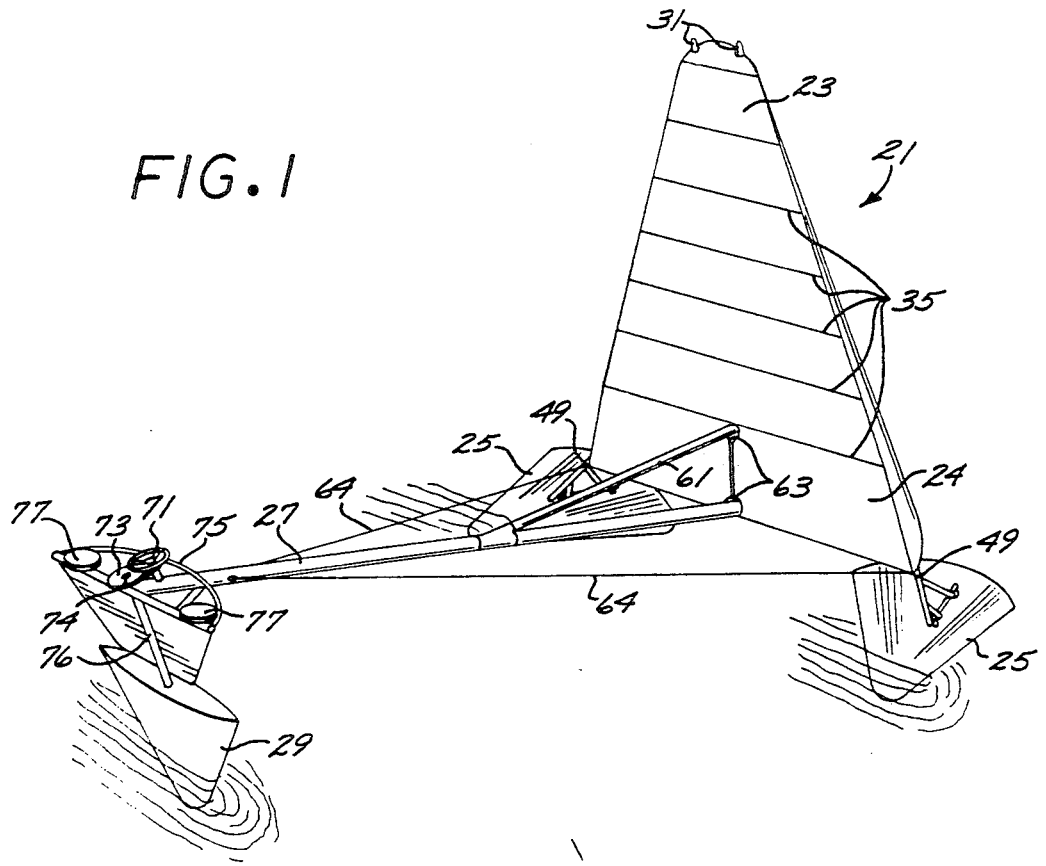
FIG. 1 is a perspective view of a watercraft embodying features of the present invention.

As shown in the drawings, which are included for purposes of illustration, but not by way of limitation, the invention is embodied in a wind-powered watercraft 21 of the type utilizing an airfoil 23 for propulsion and buoyant hydrofoils 25 for support. A buoyant keel/rudder 29, fully symmetrical both edge to edge as well as side to side, is rotatably mounted to an outwardly extending boom 27 which is rotatably affixed near the base of the airfoil 23. This arrangement of airfoil, hydrofoils and control surface, as more particularly described hereinafter, provides a high-performance watercraft that is ultrastable and which can be sailed at most wind angles.

Figure 2:
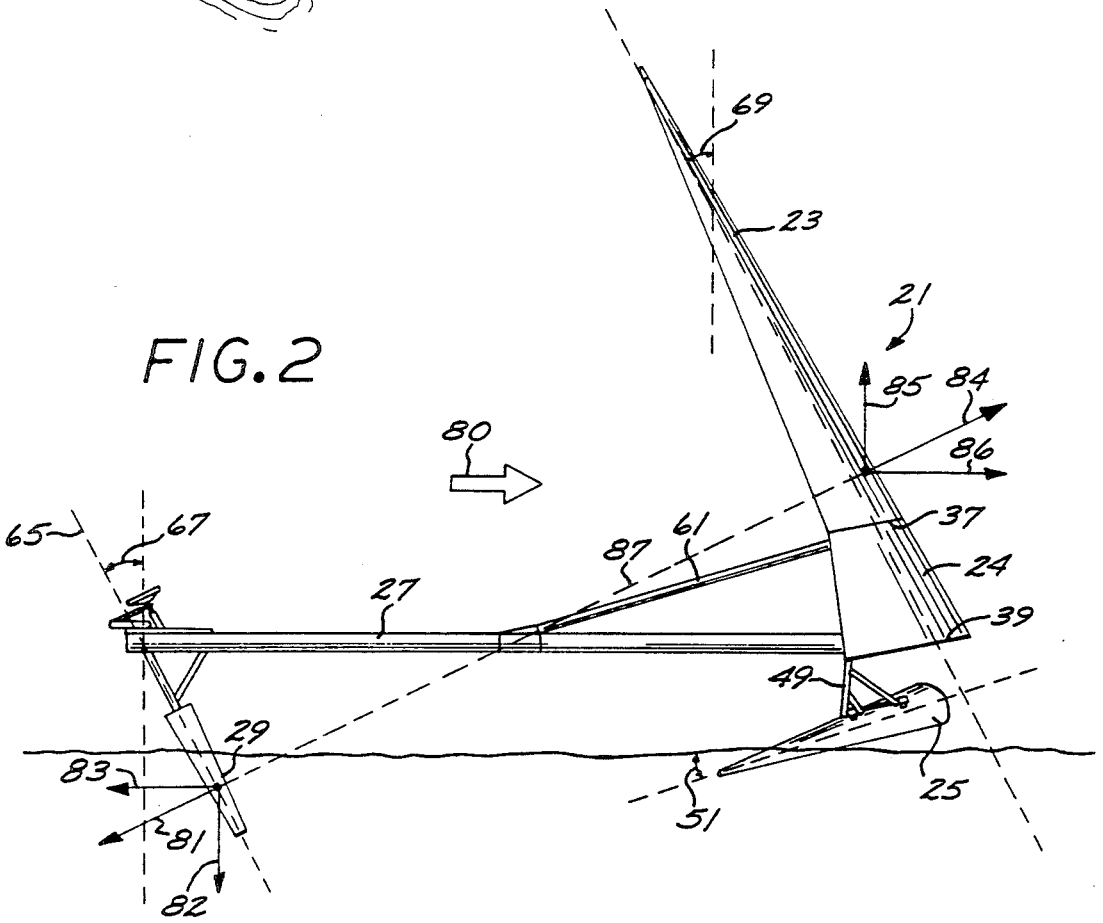
FIG. 2 is a side view of the watercraft shown in FIG. 1.
Figure 3:
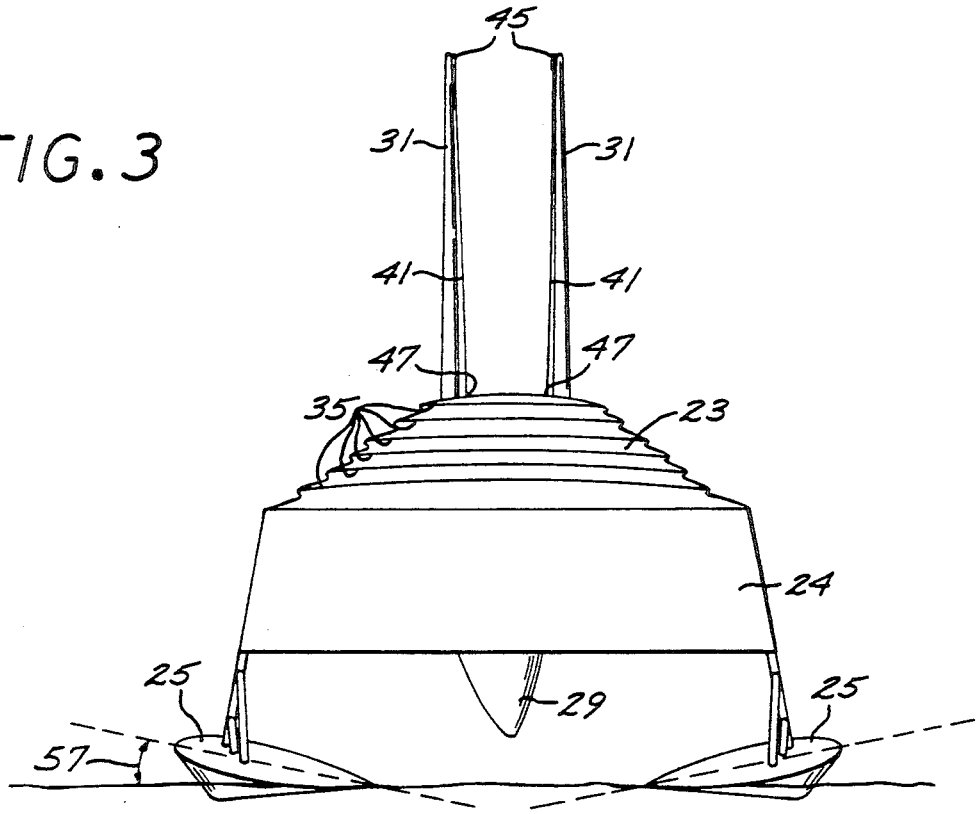
FIG. 3 is a front view of the watercraft of FIG. 1 with its airfoil in its lowered position.
Figure 4:
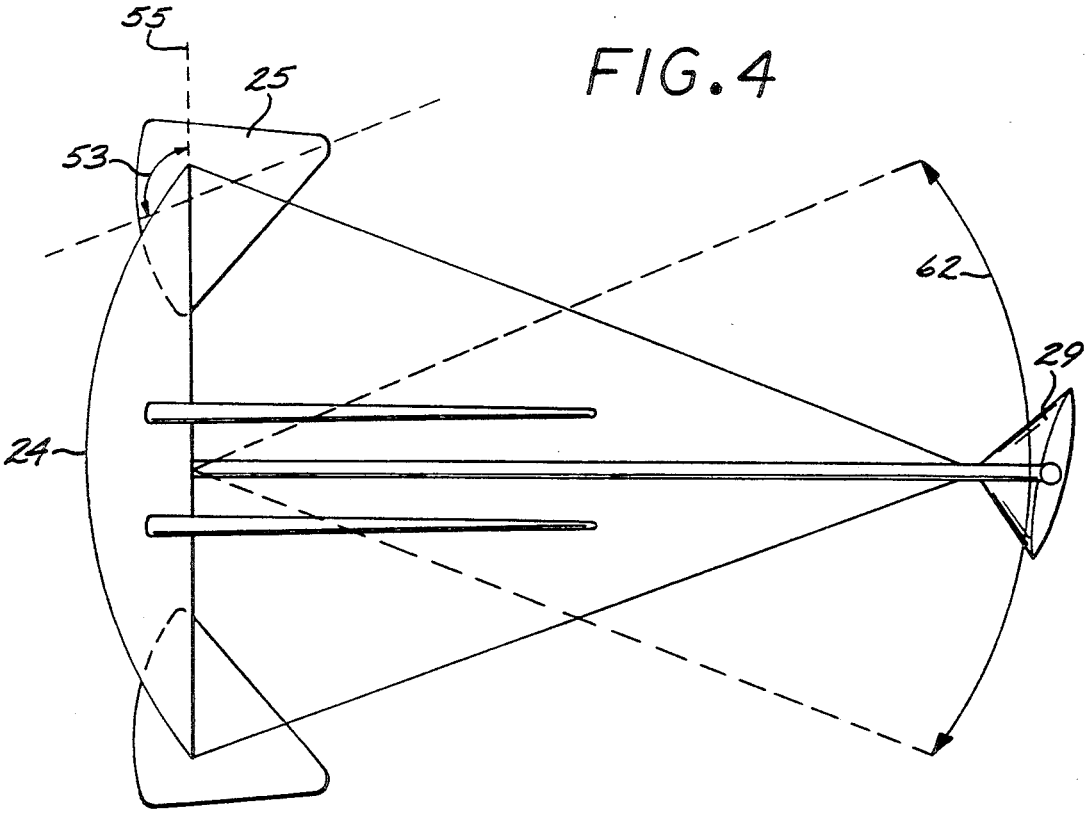
FIG. 4 is a top view of the watercraft of FIG. 3.
Figure 5:
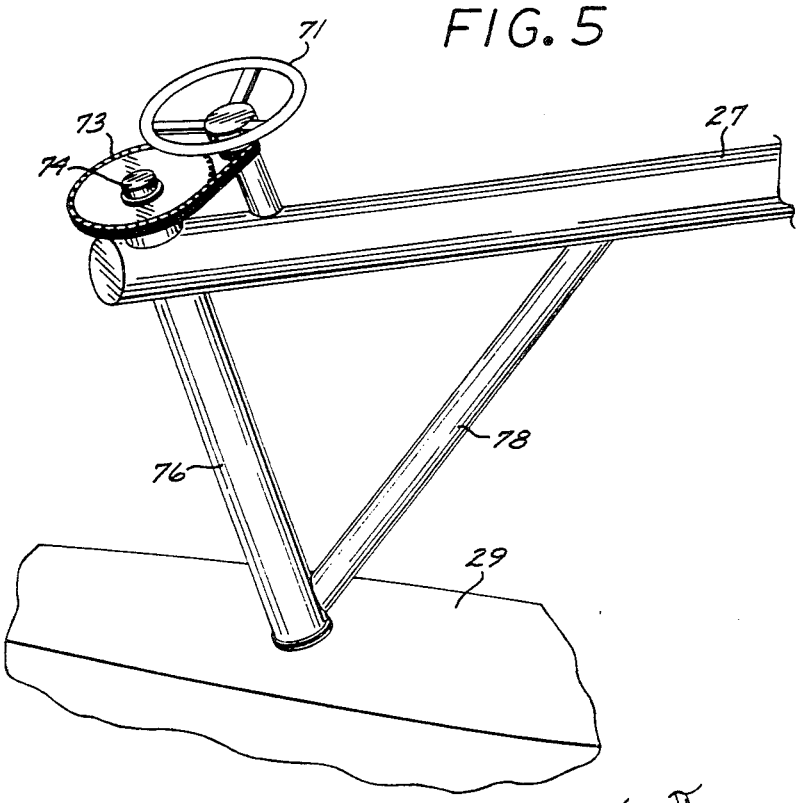
FIG. 5 is a detailed perspective view in enlarged scale of a steering mechanism employed by the watercraft of the present invention.
Figure 6:
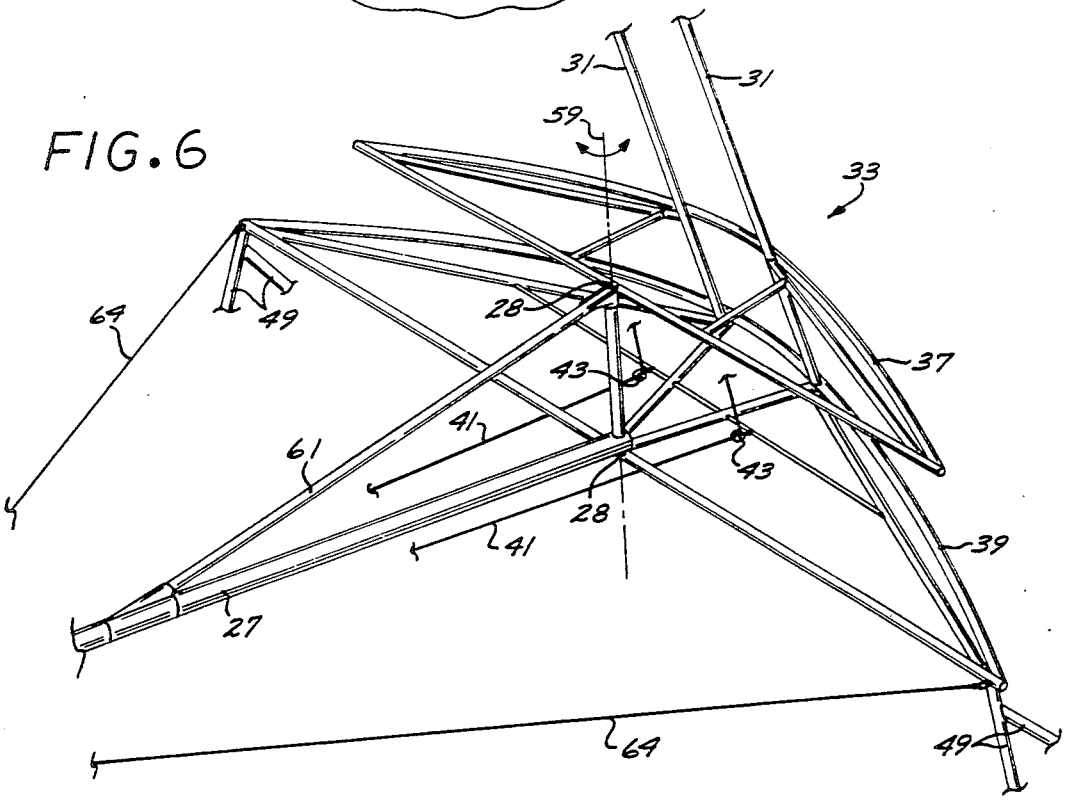
FIG. 6 is a detailed perspective view in enlarged scale of structural framework within the watercraft of the present invention.

The most prominent element of the watercraft 21 of the present invention is the airfoil 23. The airfoil 23 comprises a fully ribbed 35 sailcloth structure that is raised and lowered along the upwardly extending twin masts 31. FIGS. 1 and 2 show the airfoil 23 in its fully raised position while FIGS. 3 and 4 illustrate the watercraft with the airfoil 23 in its fully lowered collapsed position. The individual ribs 35 are sewn into or otherwise incorporated in the sailcloth and serve to impart the airfoil shape to the otherwise uncontrolled form of the sail. The lower portion 24 of the airfoil encloses the rigid framework 33 of the watercraft an cannot be raised or lowered. Framework members 37 and 39 impart the airfoil shape to the sailcloth and additionally support the base of the twin masts 31 as is shown in FIG. 6. The masts 31 extend upwardly at an angle 69 to the vertical. With the airfoil 23 deployed about said masts 31 as shown, horizontally moving air is deflected to provide a vertical lifting force component as well as horizontal force vector. Airfoil 23 is symmetrical edge-to-edge (with respect to the perpendicular bisector of its aerodynamic chord) such that lift is produced with air flowing in either direction across its surfaces. Twin halyards 41 run through the blocks 43 attached near the base of the framework 33, through blocks 45 attached near the top of the masts 31, and finally are affixed to the top of the airfoil at 47.

Framework 33 additionally locates the supports 49 for the two hydrofoils 25. Each hydrofoil describes a substantially isosceles triangle having a symmetric cross section (with respect to the perpendicular bisector of the chord) defining a lifting profile. FIGS. 2 and 3 illustrate the hydrofoils' angled positioning 51, 57 relative to the horizontal while FIG. 4 illustrates the hydrofoils' positioning or angling 53 relative to the centerline 55 of framework 33.

In the preferred embodiment, rigid boom 27 is rotatably affixed to the framework 33 as illustrated in FIG. 6. The locating points 28 are selected such that the axis of rotation 59 of the boom 27 is substantially along the vertical. Strut 61 serves to strengthen the joint. Holes 6 in the airfoil 23 allow the boom 27 and strut 61 to pass through the airfoil 23 to their points of attachment. It has been found that a 50 freedom of rotation 62 as illustrated in FIG. 4 is sufficient to allow the craft to be properly "trimmed" under most sailing conditions. Twin mainsheets 64 are attached at the extreme ends of frame member 39 and are gathered at the distal end of the boom 27. Alternatively, the boom 27 may be rigidly affixed to framework 33 (not shown).

Boom 27 extends outwardly from rigid framework 33 and has at its distal end rotatably attached thereto the keel/rudder 29. The keel/rudder has a generally triangular profile with a fully symmetrical foil shape, i.e. symmetrical both edge to edge as well as side to side, is constructed of buoyant material and displaces sufficient volume to support this extended section of watercraft, in addition to the weight of the crew. The keel/rudder's axis of rotation 65 is angled 67 from the vertical. The axis of rotation is substantially parallel with the plane of the airfoil 23 and hence angle 67 is substantially equal to angle 69.

The size, shape and angles of inclination of the keel/rudder 29 and air foil 23 are selected such that no net capsizing moment results when leeward resistance is generated by the keel/rudder 29 to the forces generated by the airfoil 23 turned to the wind. FIG. 2 illustrates the relevant force vectors. Air moving in direction 80 is deflected by angled airfoil 23 to generate force vector 84 having a vertical component 85 as well as horizontal component 86. Keel/rudder 29, turned so as to resist movement resulting from force 86, generates force vector 81 having a vertical component 82 as well as horizontal component 83. Due to equal and opposite magnitudes of the force vectors and due to their substantial alignment 87, no net turning moment is generated regardless of wind velocity and the craft is therefore ultrastable.

The keel/rudder 29 has a substantial freedom of rotation about its axis 65, at least 180° is required and a full 360° is preferred. In the embodiment illustrated in FIGS. 1, 2 5 and 7 its angular orientation is controlled via a steering wheel 71. A reduction gear arrangement 73 reduces the effort required to turn steering wheel 71. Shaft 74 rotatably located within housing 76 serves to transmit rotation of the reduction gear 73 to rotation of the keel/rudder 29. Strut 78 strengthens the entire steering structure. Frame member 75 supports stools 77 which provide seating for the crew. Both halyards 41 and both mainsheets 64 are routed to within reaching distance of the stools and are made fast via, for example, jam cleats, or a winch and cleat arrangement. (not shown)

Figure 10:
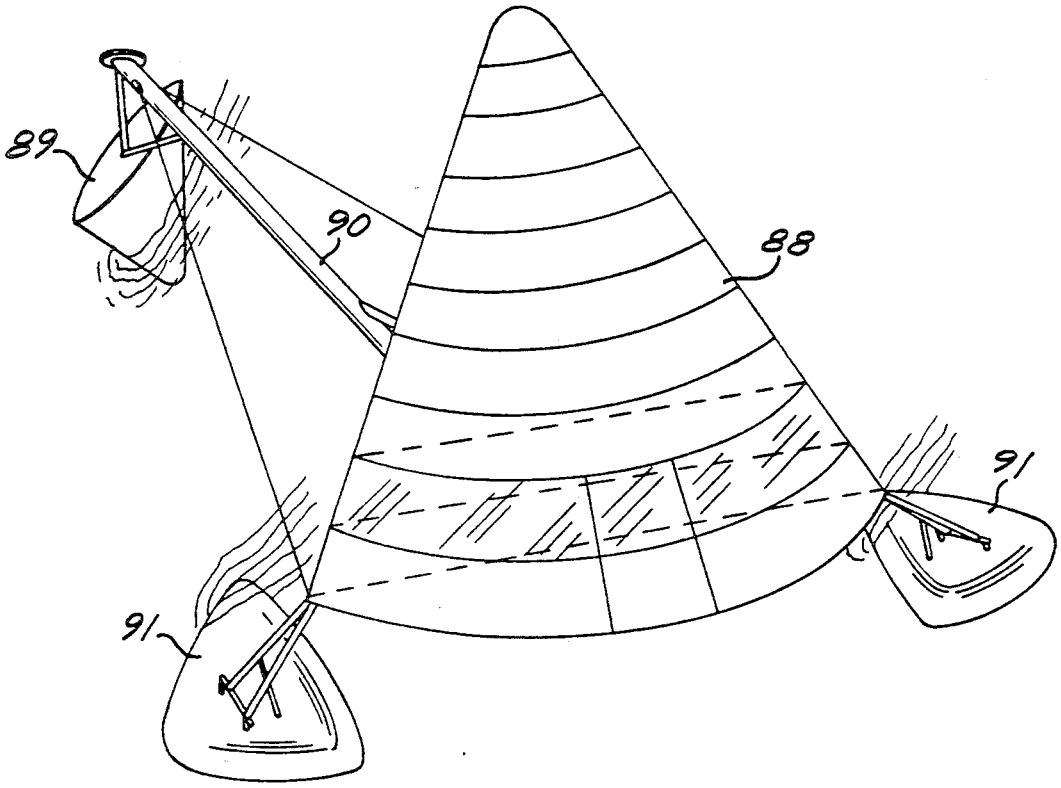
FIG. 10 is a perspective view of an alternative embodiment of the present invention.

In the alternative embodiment illustrated in FIG. 10, the crew and helm is accommodated within the interior of airfoil 88. The position of the keel/rudder 89 is remotely controlled from therewithin as is the position of boom 90. The buoyancy and lift of hydrofoils 91 is increased to support the added weight of the crew thereabove, while the buoyancy of keel/rudder 89 is commensurately decreased.

Materials used for the construction of the above described watercraft include the following:

The hydrofoils 25 as well as the keel/rudder 29 are constructed of foam filled fiberglass. Such construction provides a sturdy and robust structure, is light enough to impart a substantial amount of buoyancy to the entire craft and can be precisely shaped to optimize the surface form. All framework members, booms, masts, etc. are formed of aluminum tubing which is easily cut, bent and heliarced to form the structure illustrated in the figures. Alternatively, composite construction may be substituted where appropriate. The sailcloth comprises Dacron or Kevlar panels which are sewn into the shape illustrated in the drawings, and additionally incorporate rigid aluminum ribs 35.

In operation, the craft 21 is launched with the airfoil 23 in its completely collapsed position as illustrated in FIG. 3. The airfoil 23 is raised by hauling in and cleating off halyards 41. The progress of the watercraft is generally dictated by the rotational orientation of the keel/rudder 29. In addition, the orientation of the airfoil relative to the wind can be optimized by changing the angle of the boom 27 relative to the centerline 55 of the watercraft. This is accomplished by hauling in on one of the mainsheets 64 and easing off on the opposite mainsheet 64.

FIG. 7 illustrates various sailing angles and orientations possible with the craft described by the present invention. The true wind direction is illustrated by the arrow 79. FIG. 7A illustrates the watercraft running downwind. The keel/rudder 29 is rotated to an orientation parallel with the direction of wind 79 and the airfoil 23 is turned perpendicularly thereto to expose its flat expanse to the force of the wind. The hydrofoils' positioning in the water offer no leeward resistance, and under these particular conditions (7A) are induced to a planing attitude.

Figure 7A:
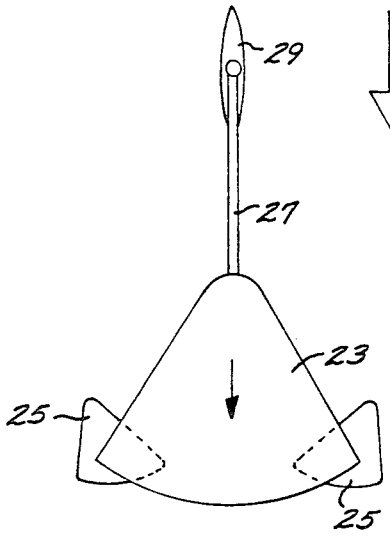
FIGS. 7A–F are diagrammatic representations showing the orientation of the watercraft of the present invention at different pointing angles.
Figure 7B:
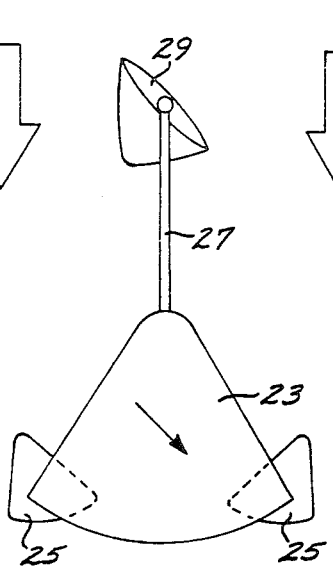
Figure 7C:
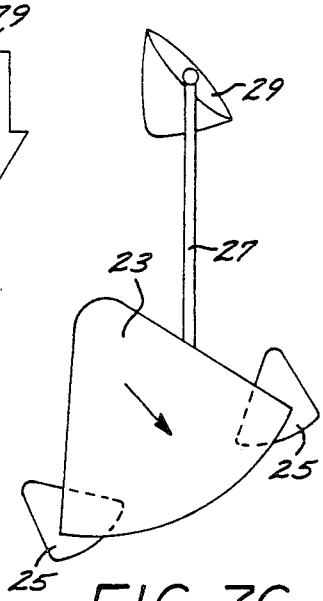
Figure 7E:
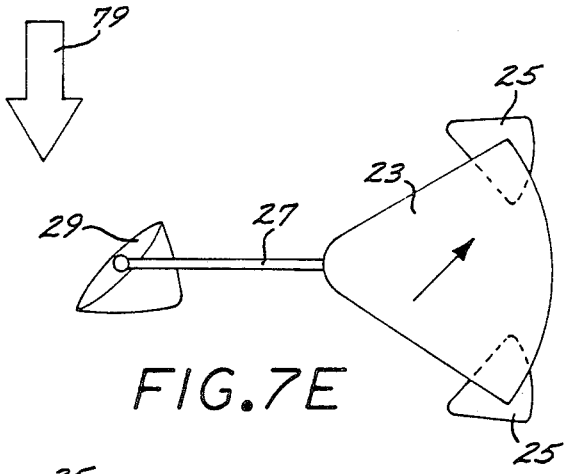
Figure 7D:
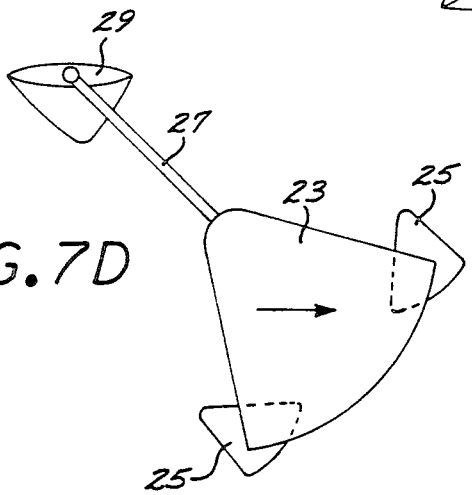
Figure 7F:
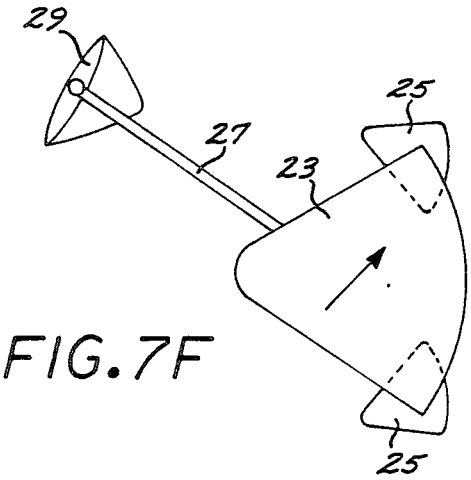

FIGS. 7B and 7C illustrate a broad reach. Again, the orientation of the keel/rudder 29 determines the direction of progress, the angle of progress being substantially parallel to the orientation of the keel/rudder. The difference between FIGS. 7B and 7C illustrate a slightly different trimming of the boom 27 resulting in the same direction of travel. The boom is trimmed to maximize propulsive force as when compensating for the deviation of the apparent wind direction from the actual wind direction due to the watercraft's varying speed. FIG. 7D illustrates a beam reach, while FIGS. 7E and 7F illustrate a close-hauled attitude.

As is apparent from the illustrations, the hydrofoils' positioning and orientation is such that a vector component of water flowing across the hydrofoils is in parallel with the foils' chords at all sailing angles other than the situation illustrated in FIG. 7A. The higher the craft velocity and/or the closer the craft's forward direction actually parallels the foils' chord, the more lift is produced. Lift reduces both frontal as well as wetted area by lifting the entire craft upwardly, thereby reducing drag and thereby enabling higher speed to be attained.

Figure 8:
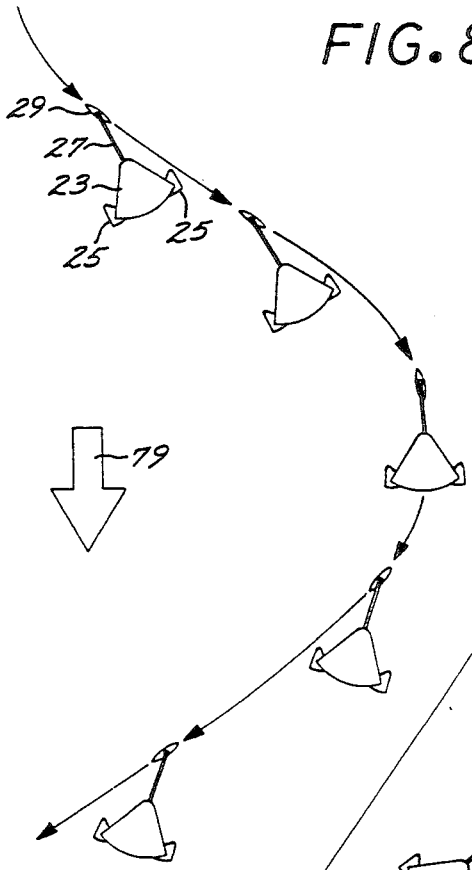
FIG. 8 is a diagrammatic representation showing the watercraft of the present invention jibing.

FIG. 8 illustrates the watercraft of the present invention downwind tacking or jibing. The keel/rudder 29 is turned and the airfoil 23 repositioned relative to the wind as illustrated to cause the craft to change direction relative to the wind direction 79. The craft does not need to be stopped nor slowed to perform such maneuvers. The positioning of the hydrofoils 25 and the rotatability of the keel/rudder 29 as described above provide for this improvement in maneuverability.

Figure 9:
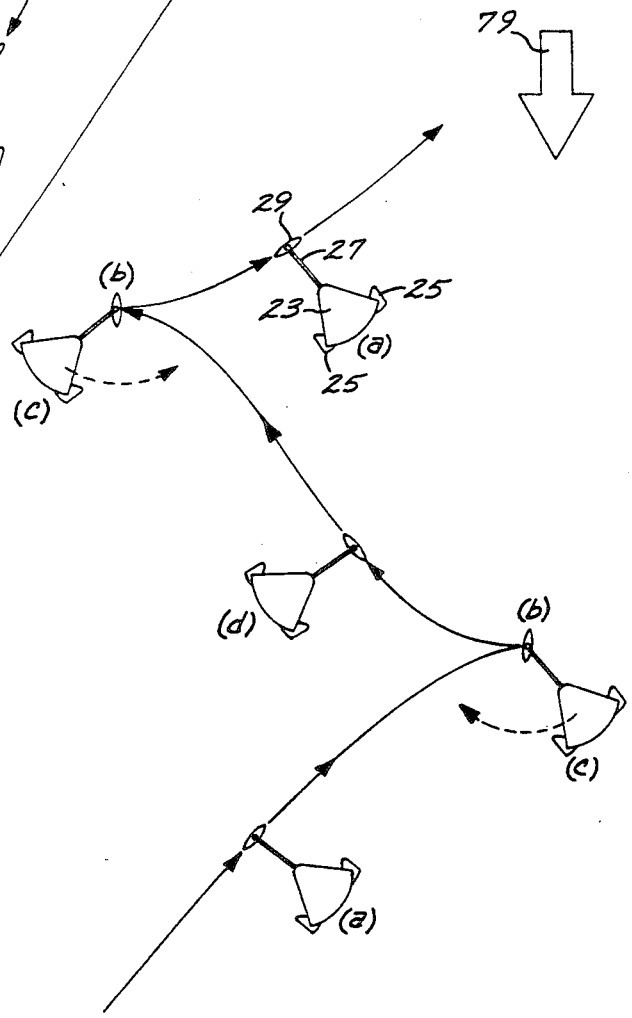
FIG. 9 is a diagrammatic representation showing the watercraft of the present invention tacking.

FIG. 9 illustrates an upwind tacking maneuver. In order to tack while the craft is proceeding towards the oncoming wind (a) the keel/rudder 29 is first turned into the wind (b), to bring the keel/rudder 29 to a stop. While the airfoil 23 swings to the leeward (c), the keel/rudder 29 is turned back off the wind and gradually turned back into the wind as the craft accelerates on the opposite tack (d) to proceed as illustrated. This type of maneuver causes the craft to come to halt at the apex of each tack and causes the air flow across the airfoil 23 to change direction with each tack.

Obviously, many modifications and variations of the present invention are possible in light of the above teachings. It is, therefore, to be understood that within the scope of the appended claims the invention may be practiced otherwise than specifically described.

What is claimed is:

1. A high-speed, ultra stable, wind propelled watercraft, comprising:

an airfoil, having a windward surface and a leeward surface;

buoyant hydrofoil means for supporting said airfoil on a plane of floatation such that said airfoil's windward surface is normally angled toward said plane of floatation to thereby describe an angle of inclination, said hydrofoil means being configured to provide a vertical lift component when moving through water while offering substantially no leeward resistance;

a boom extending substantially horizontally from the windward surface of said airfoil;

a buoyant keel/rudder rotatably affixed to the distal end of said boom, said keel/rudder being symmetrical both side to side as well as edge to edge, having an axis of rotation substantially parallel with the angle of inclination of the airfoil and rotatable through at least a 180° arc; and control means for controlling the rotational position of said keel/rudder.

2. The water craft of claim 1 wherein said airfoil's windward and leeward surfaces are configured such that air flowing across said surfaces produces "lift" to the leeward and the airfoil is symmetric edge-to-edge such that lift is produced with air flowing in either direction across said surfaces.

3. The watercraft of claim 2 wherein said airfoil comprises sailcloth enveloping a rigid rib structure.

4. The watercraft of claim 1, wherein said keel/rudder is rotatable through full 360°.

5. The watercraft of claim 4, further comprising:

means for rotatably mounting the proximal end of said boom near said airfoil such that said boom swings about a substantially vertical axis; and means for adjustably controlling said boom's position.

6. The watercraft of claim 1 further comprising means for accommodating a crew near the distal end of said boom.

7. A watercraft, comprising:

airfoil means, affixed to said watercraft, having a windward surface and a leeward surface configured and positioned to generate an upwardly inclined force vector in response to horizontally moving air impinging on said windward surface while said watercraft is in its normally horizontal position;

buoyant support means for supporting said watercraft on a plane of floatation and configured to offer substantially no leeward resistance to the watercraft's movement in water; and a variably positionable control surface configured to generate a downwardly inclined force vector of variable magnitude in response to leeward movement of said watercraft in water, said control surface being positionable to substantially align its downwardly inclined force vector with the upwardly inclined force vector of the airfoil and further being positionable to reduce the magnitude of said downwardly inclined force vector to substantially zero, said control surface comprising said watercraft's sole means for substantially resisting leeward motion.

8. The watercraft of claim 7 wherein said buoyant support means comprise hydrofoil surfaces that generate lift when moving through water.

9. The watercraft of claim 7 wherein said control surface comprises a keel/rudder rotatable about an axis inclined from the vertical.

10. The watercraft of claim 9 wherein said keel/rudder is symmetric both side to side as well as edge to edge.

11. The watercraft of claim 9 wherein said keel/rudder is buoyant and serves to support a substantial portion of said watercraft.

12. The watercraft of claim 7 wherein said airfoil's windward surface is inclined toward the plane of floatation to describe an angle of inclination.

13. The watercraft of claim 12 wherein said control surface comprises a keel/rudder rotatable about an axis substantially parallel with the airfoil's angle of inclination and laterally offset substantially to the windward.

14. The watercraft of claim 13 further comprising means for rotating the position of said keel/rudder's axis of rotation about said airfoil along a horizontal plane.

* * * * *